US007419494B2

(12) United States Patent
Hashiguchi et al.

(10) Patent No.: US 7,419,494 B2
(45) **Date of Patent: *Sep. 2, 2008**

(54) HAIR REMOVING DEVICE

(75) Inventors: Tetsurou Hashiguchi, Hikone (JP); Hidekazu Sueyoshi, Kanzaki-gun (JP)

(73) Assignee: Matsushita Electric Works, Ltd., Osaka (JP)

( * ) Notice: Subject to any disclaimer, the term of this patent is extended or adjusted under 35 U.S.C. 154(b) by 291 days.

This patent is subject to a terminal disclaimer.

(21) Appl. No.: 10/508,797

(22) PCT Filed: Mar. 25, 2003

(86) PCT No.: PCT/JP03/03667

§ 371 (c)(1),
(2), (4) Date: Sep. 21, 2004

(87) PCT Pub. No.: WO03/079845

PCT Pub. Date: Oct. 2, 2003

(65) Prior Publication Data

US 2005/0143755 A1 Jun. 30, 2005

(30) Foreign Application Priority Data

Mar. 26, 2002 (JP) ..... 2002-087088

(51) Int. Cl.
*A61B 17/50* (2006.01)

(52) U.S. Cl. ..... 606/133; 30/30

(58) Field of Classification Search ..... 606/133; 30/43.7, 43, 42, 51, 532
See application file for complete search history.

(56) References Cited

U.S. PATENT DOCUMENTS 3,672,049 A * 6/1972 Demci et al. ..... 30/537
3,858,314 A 1/1975 Brenneman et al.

(Continued)

FOREIGN PATENT DOCUMENTS

EP 0 408 095 A1 1/1991

(Continued)

OTHER PUBLICATIONS

International Preliminary Examination Report for PCT/JP03/03667 completed on Jun. 25, 2004.

(Continued)

*Primary Examiner*—Anhtuan T. Nguyen
*Assistant Examiner*—Natalie Pous
(74) *Attorney, Agent, or Firm*—Rader, Fishman & Grauer PLLC

(57) ABSTRACT

A hair removing device capable of selectively attaching an epilator head for hair epilation and a shaving head for hair cutting. The device includes the housing incorporating the rotary motor, and the epilator or shaving head detachable to the housing. The head includes a drive mechanism powered by the motor for hair epilation or cutting. The motor has an output rotor fixedly carrying a noncircular joint. The drive mechanism includes a coupler which is detachably connected to the joint to receive the rotary motion of the motor. The coupler is arranged coaxially with the joint and is movable along the axis of the joint together with the head into and out of engagement with and from the joint, and the coupler is slidable along the axis of the joint while keeping the driving connection therebetween.

7 Claims, 13 Drawing Sheets

U.S. PATENT DOCUMENTS

| | | | | |
|---|---|---|---|---|
| 4,167,060 | A | 9/1979 | Sakamoto | |
| 4,960,422 | A | 10/1990 | Demeester | |
| 5,611,145 | A * | 3/1997 | Wetzel et al. | 30/43.92 |
| 6,287,190 | B1 * | 9/2001 | Inoue et al. | 452/82 |
| 6,730,100 | B2 * | 5/2004 | Yamaguchi et al. | 606/133 |

FOREIGN PATENT DOCUMENTS

| | | | |
|---|---|---|---|
| EP | 0 442 419 | A2 | 8/1991 |
| EP | 1 072 212 | A2 | 1/2001 |
| EP | 1 212 960 | A1 | 6/2002 |
| JP | 08-010039 | A | 1/1996 |
| JP | 2001-087573 | A | 4/2001 |
| JP | 2001-120340 | A | 5/2001 |
| JP | 2001-149135 | A | 6/2001 |
| JP | 2001-269216 | A | 10/2001 |

OTHER PUBLICATIONS

International Search Report for PCT/JP03/03667 mailed on Aug. 11, 2003.

JPO Office Action "Notification of Reasons for Refusal" (4 pages) with English Translation (4 pages), App. No. 2002-087088, Jul. 24, 2007, Examiner M. Kanemoto.

* cited by examiner

HAIR REMOVING DEVICE

TECHNICAL FIELD

The present invention is directed to a hair removing device for epilating hairs from a user's skin, and more particularly to a hair removing device with a detachable epilator head.

BACKGROUND ART

U.S. Pat. No. 4,960,422 discloses a hair removing device having a detachable epilator head that can be separated from a grip housing for cleaning the head, or for replacement with an analogous shaving head. A rotary motor is incorporated in the housing to provide a driving force of epilating or shaving the hairs. Due to the detachable nature of the device, the housing also includes a gear which is driven by the motor and is responsible for detachable meshing engagement with an associated gear provided in the epilator head or the shaving head. That is, the epilator head is drivingly connected to the motor by meshing engagement of the gears when the epilator head is attached to the housing. With this gear connection, however, the device suffers from a strict dimensional tolerance between the gears, i.e., a distance between the axes of the gears for successfully transmitting the driving force from the motor to movable members in the head, which in turn requires a correspondingly strict detachable connection between the housing and the detachable head. Further, when the head is operating under a heavy load, the gear connection is likely to transmit vibrations occurring in the heavy load operation of the head directly to the housing, thereby generating harsh vibrations which detract from a comfortable operation by the user grasping the housing.

DISCLOSURE OF THE INVENTION

The above problem has been reduced in the present invention which provides an improved hair removing device which is capable of giving design flexibility to the connection between a housing and a detachable epilator head, without requiring a strict driving connection between a motor in the housing and a drive mechanism in the head. The hair removing device in accordance with the present invention includes the housing incorporating the rotary motor, and the epilator head detachable to the housing. The epilator head carries epilation members for epilation of a user's hairs and includes a drive mechanism powered by the motor to actuate the epilation members. The motor has an output rotor fixedly carrying a noncircular joint. The drive mechanism includes a coupler which is detachably connected to the joint to receive the rotary motion of the motor. The coupler is arranged coaxially with the joint and is movable along the axis of the joint together with the epilator head into and out of engagement with and from the joint, and the coupler is slidable along the axis of the joint while keeping the driving connection therebetween. Thus, the driving connection between the head and the motor can be established or disconnected simply by moving the coupler towards and away from the joint, while giving sufficient tolerance in the axial direction of the joint for keeping the driving connection. With this result, the driving connection can be easily established for successfully driving the epilation members even if there should be some gap in a mounting structure between the housing and the epilator head. Further, this simple slidable driving connection can be free from a harsh meshing engagement as seen in the gear connection, thereby avoiding the transmission of harsh vibrations from the epilator head to the housing for assuring a comfortable operation, in addition to reducing a noise.

Preferably, the coupler is in the form of a sleeve defining therein a socket hole into which the joint fits. The coupler is recessed from a bottom end of the epilator head such that the epilator head detached from the housing can be placed upright on a supporting surface with the coupler concealed in the bottom of the head.

The epilator head is preferred to carry a cylinder having a center axis along which a plurality of the epilation members are arranged. The drive mechanism includes a first linkage leading from the coupler for shifting the epilation members along the center axis towards and away from one another in order to pinch the hairs between the adjacent epilation members and at the same time for rotating the cylinder about the center axis to pluck the hairs pinched between the members. The drive mechanism also includes a second linkage leading from the coupler for oscillating the cylinder along the center axis to give optimum hair epilation efficiency. The cylinder is arranged to have its center axis lying substantially in a coplanar relation with the axis of the joint such that the cylinder can be assembled together with the coupler and the driving linkages into the epilator head of reduced thickness.

The coupler of the epilator head may be formed integrally with a coaxial pinion which engages with a gear wheel forming a common part of the first and second linkages for packing the parts of the linkages into a limited space within the epilator head.

Further, the epilator head includes a base detachable to the housing and a frame mounting thereon a plurality of gears forming the first and second linkages in addition to the cylinder. The frame is supported to the base by way of spring means to be movable relative to the base against the bias of the spring means. Thus, vibrations occurring in the operation of the epilator head can be effectively absorbed by the spring means so as to make the housing relatively free from the vibrations, assuring a comfortable handling of the device.

The frame is movable in a direction along the axis of the joint together with the cylinder, i.e., floatingly supported to the base so that the cylinder can be depressed upon contact with the user's skin for easy and optimum epilation efficiency. The frame is movable also in a direction of the center axis for successfully absorbing the vibrations occurring in the axial direction of the cylinder due to the oscillating movement of the cylinder.

The device may include a shaving head which is selectively detachable to the housing in place of the epilator head. The shaving head carries a cutter and includes a shaving drive mechanism powered by the motor to move the cutter for cutting the hairs. The shaving drive mechanism includes a shaving coupler which is basically identical to the coupler of the epilator head for detachable driving connection to the joint on the side of the housing. Thus, the shaving head can be selectively replaced for the epilator head for cutting relatively long hairs prior to epilating the hairs by use of the epilator head.

In this regard, the coupler of the shaving head may be formed integrally with an eccentric cam which engages with a reciprocator carrying the cutter for translating the rotary motion of the motor into a reciprocating movement of the cutter.

Further, the shaving drive mechanism is designed to translate the rotary motion of the motor directly, i.e., without any intervening reduction gear, into the reciprocating movement of the cutter such that the cutter can reciprocate at a frequency higher than a rotational speed at which the cylinder of the epilator head rotates about the center axis.

These and still other objects and advantageous features of the present invention will become more apparent from the following detailed description of the preferred embodiment when taken in conjunction with the attached drawings.

DETAILED DESCRIPTION OF THE EMBODIMENT

Figure 1:
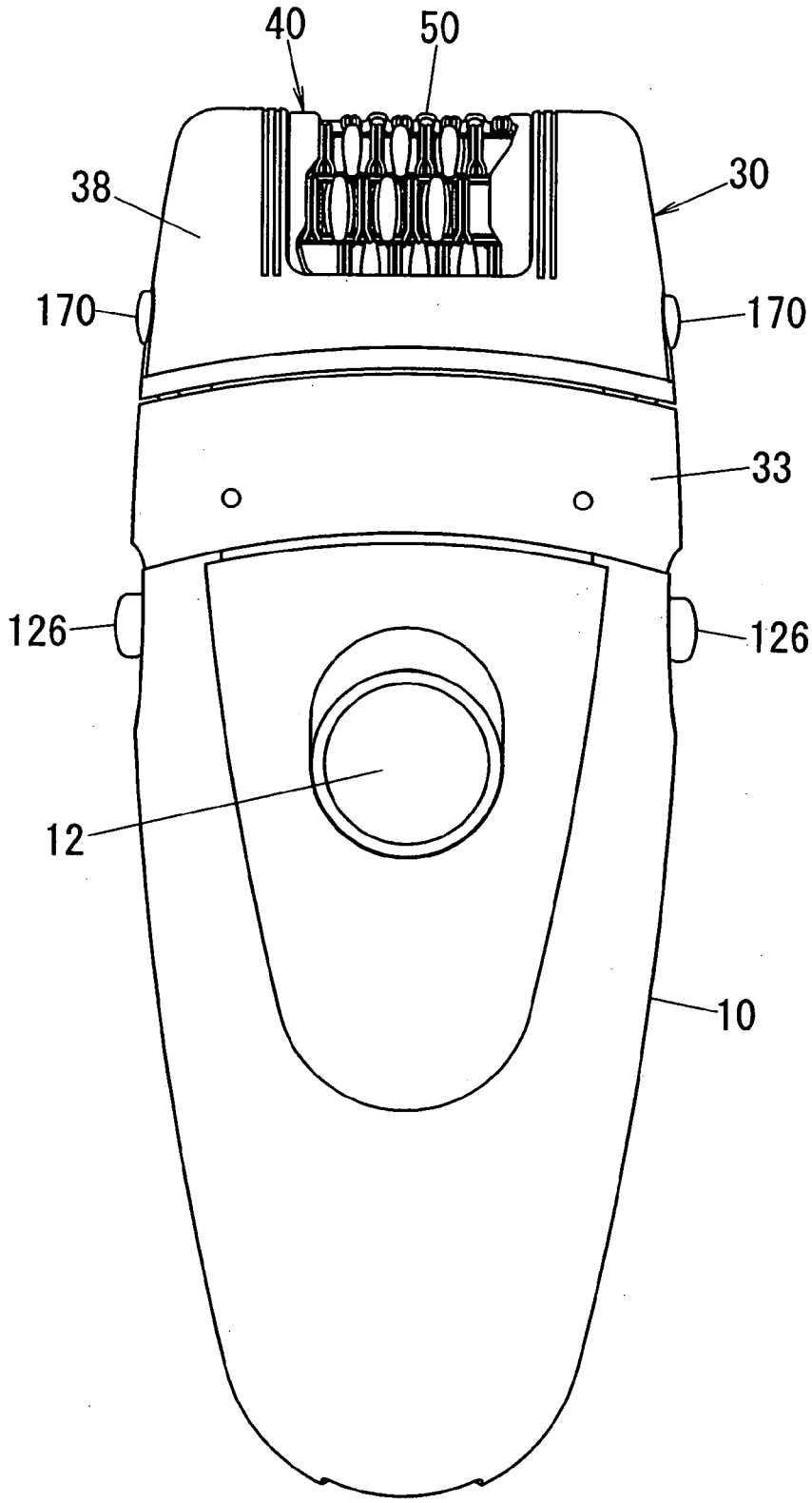
FIG. 1 is a front view of a hair removing device in accordance with a preferred embodiment of the present invention.
Figure 10:
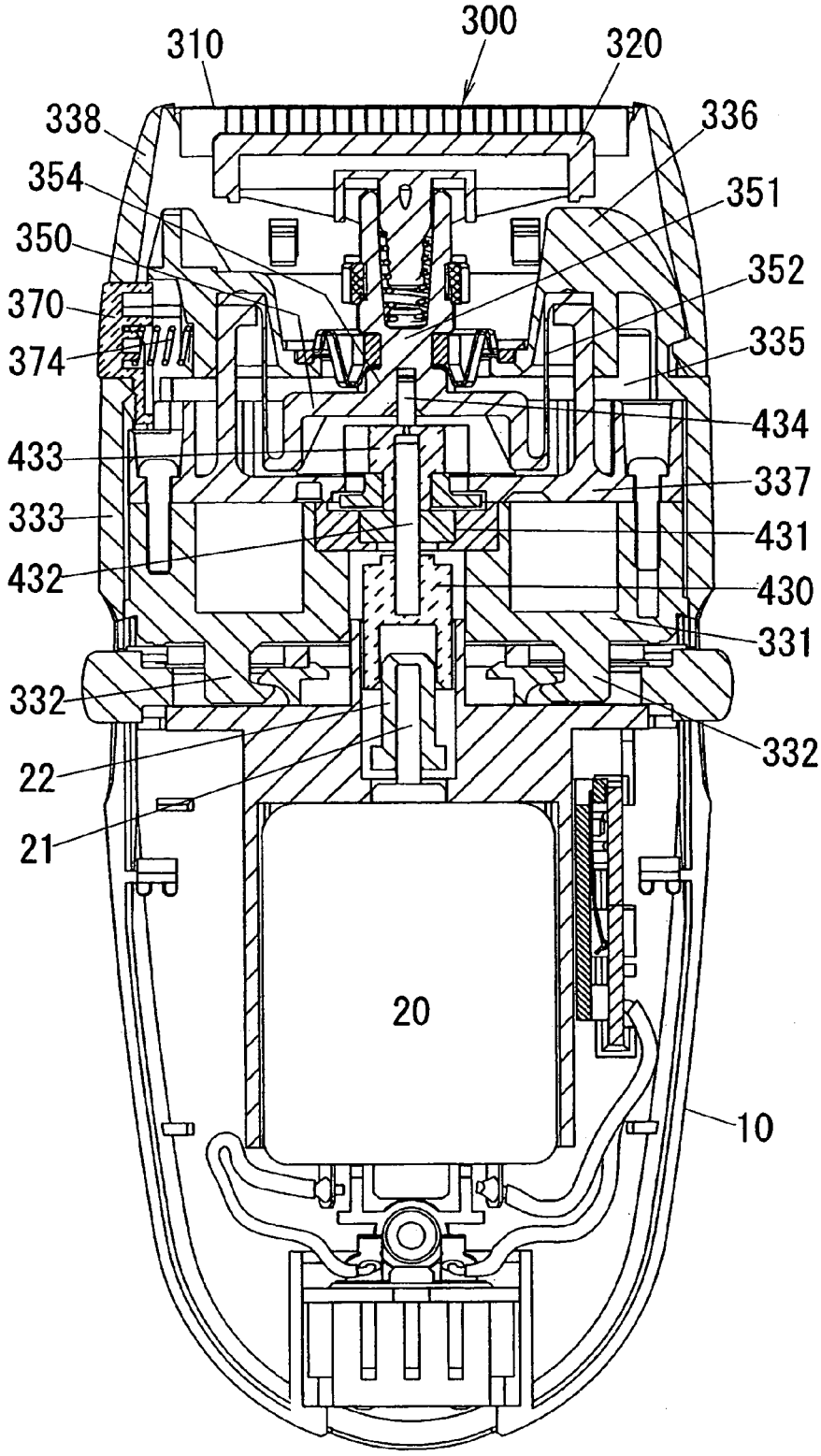
FIG. 10 is a front vertical section of the device with a shaving head attached.
Figure 11:
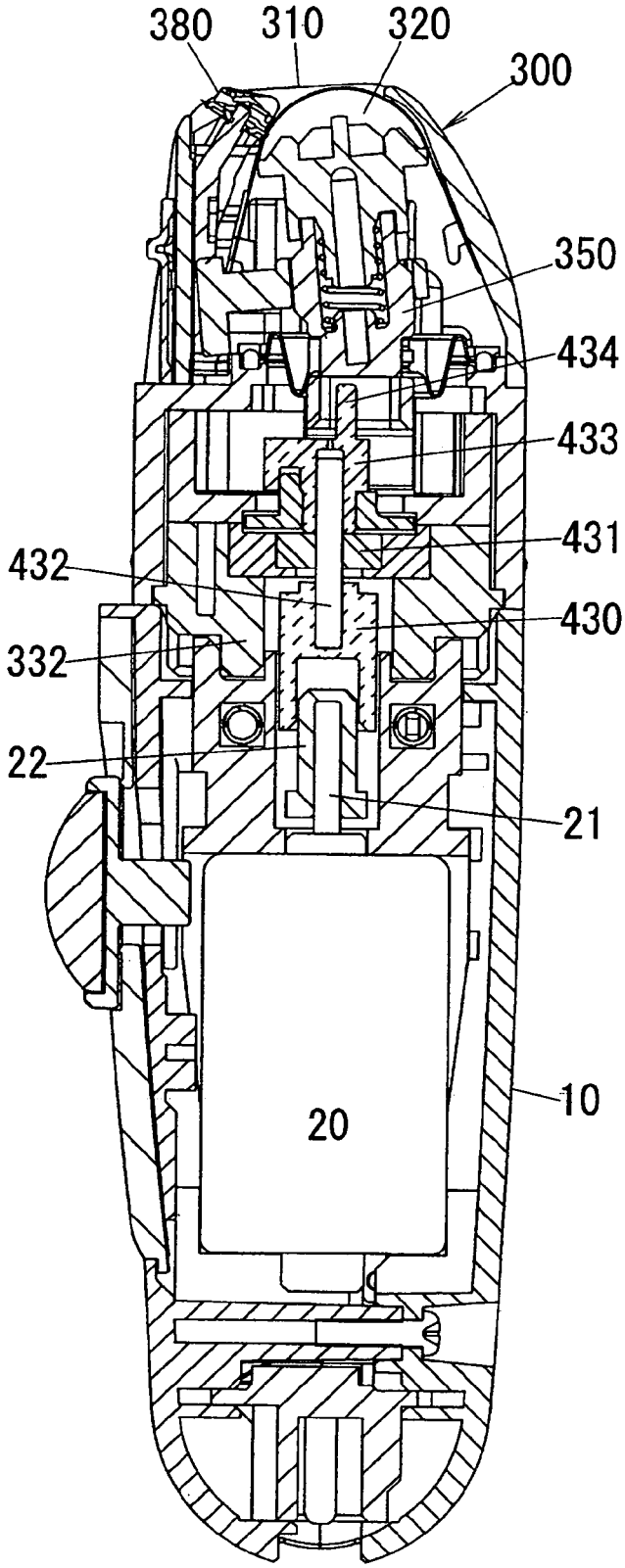
FIG. 11 is side vertical section of the device with the shaving head attached.
Figure 12:
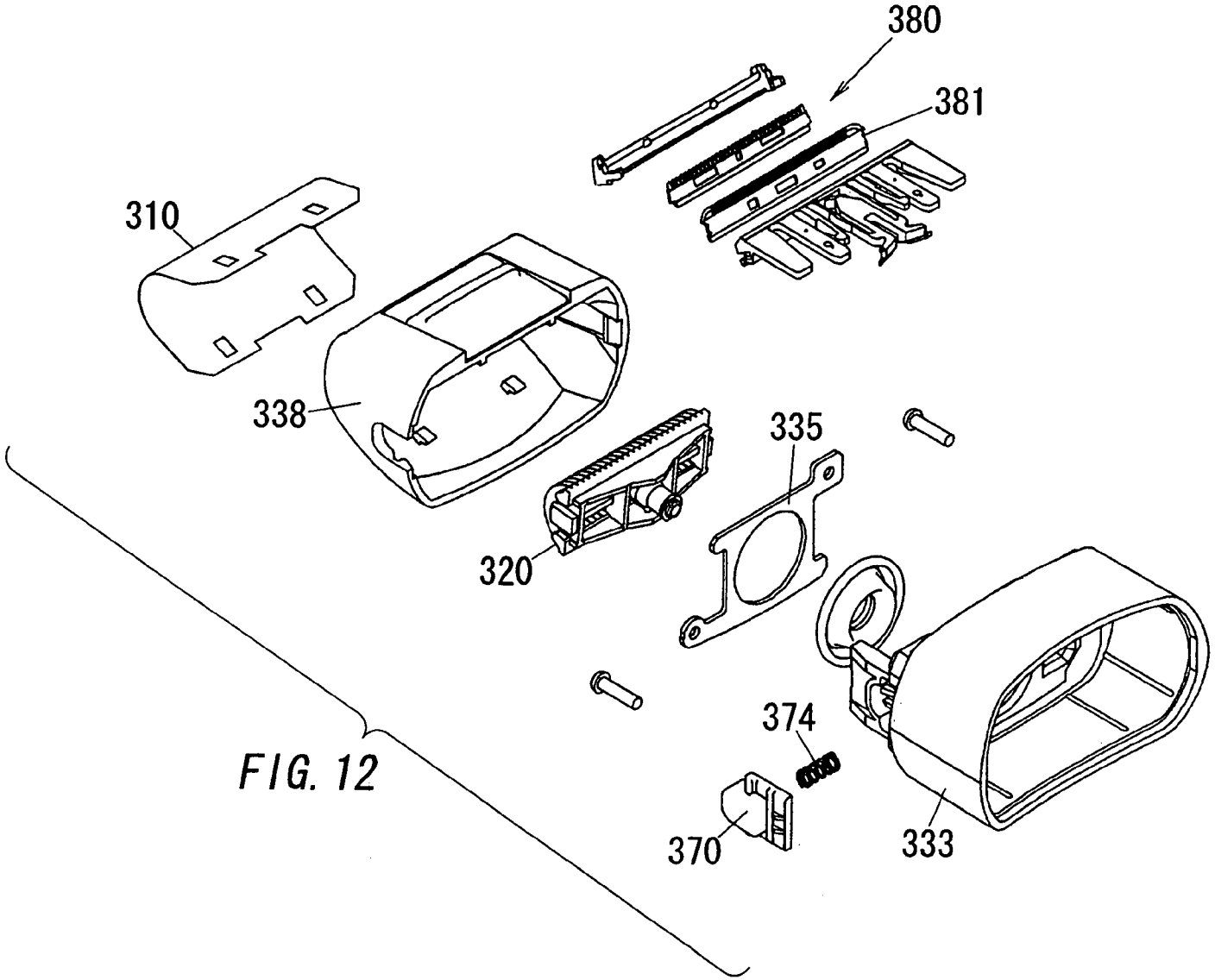
FIG. 12 is an exploded perspective view of an upper part of the shaving head.
Figure 13:
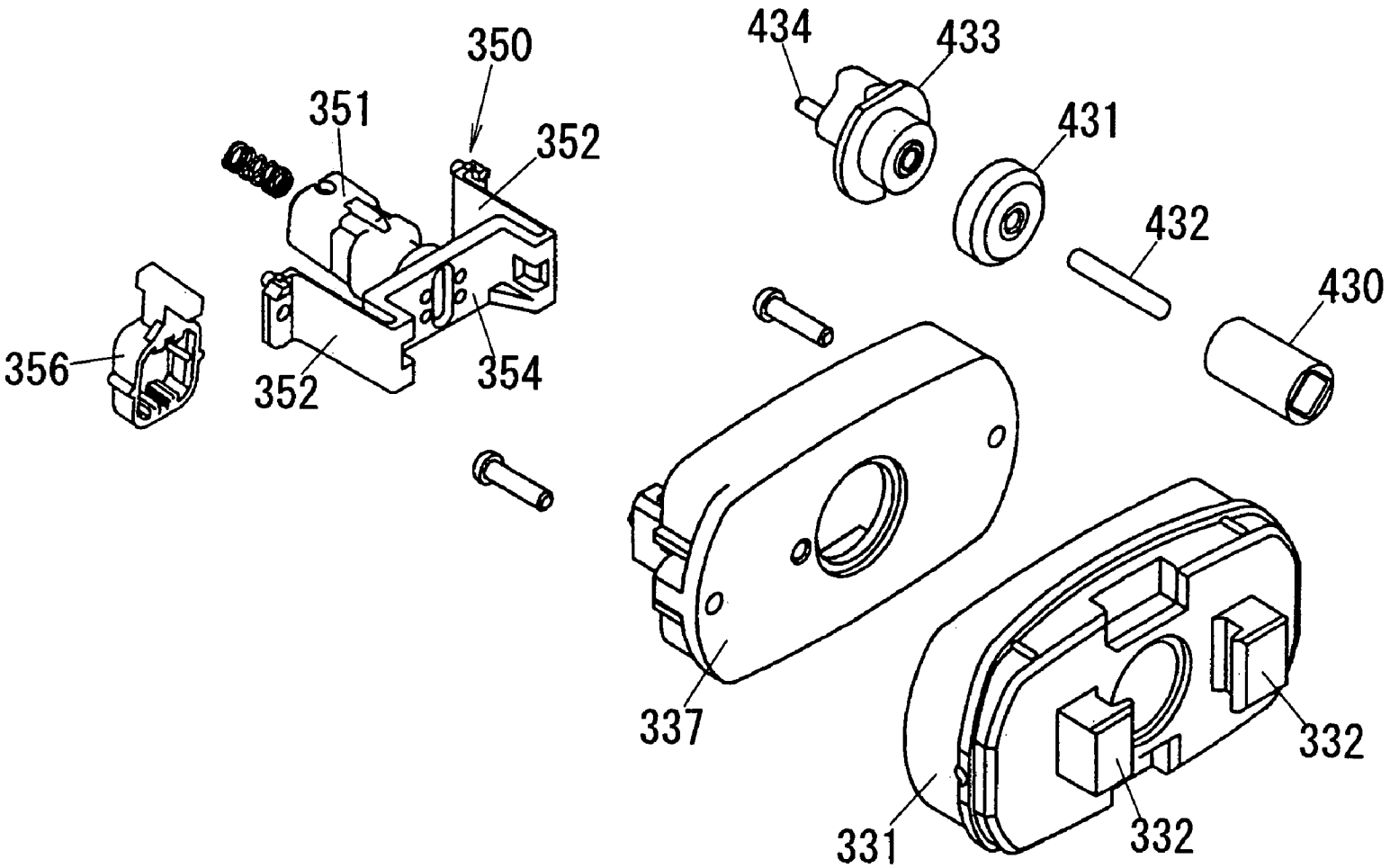
FIG. 13 is an exploded perspective view of a lower part of the shaving head.

Referring now to FIGS. 1 and 10, there is shown a hand-held hair removing device in accordance with a preferred embodiment of the present invention. The device has a housing 10 which is designed to be grasped by a user's hand and to detachably mount thereon an epilator head 30 and a shaving head 300 selectively for epilating or plucking the hairs from a user's skin and cutting the hairs prior to epilating the hairs. The housing 10 accommodates an electric rotary motor 20 having a output rotor shaft 21 extending vertically in alignment with a center vertical axis of the housing for detachable driving connection to the epilator head 30 and shaving head 300 selectively mounted on top of the housing 10. The epilator head 30 and the shaving head 300 are analogous in its shape having an elongated width extending in a perpendicular relation to the vertical axis of the housing 10. The epilator head 30 carries a rotary cylinder 40 which is driven to rotate about its center axis, i.e., the horizontal axis of the head for plucking the hair, as shown in FIG. 1, while the shaving head 300 carries an outer shearing foil 310 and an inner cutter 320 which is driven to reciprocate along the horizontal axis of the head in a shearing engagement the shearing foil 310 for cutting the hairs, as shown in FIG. 10.

Figure 4:
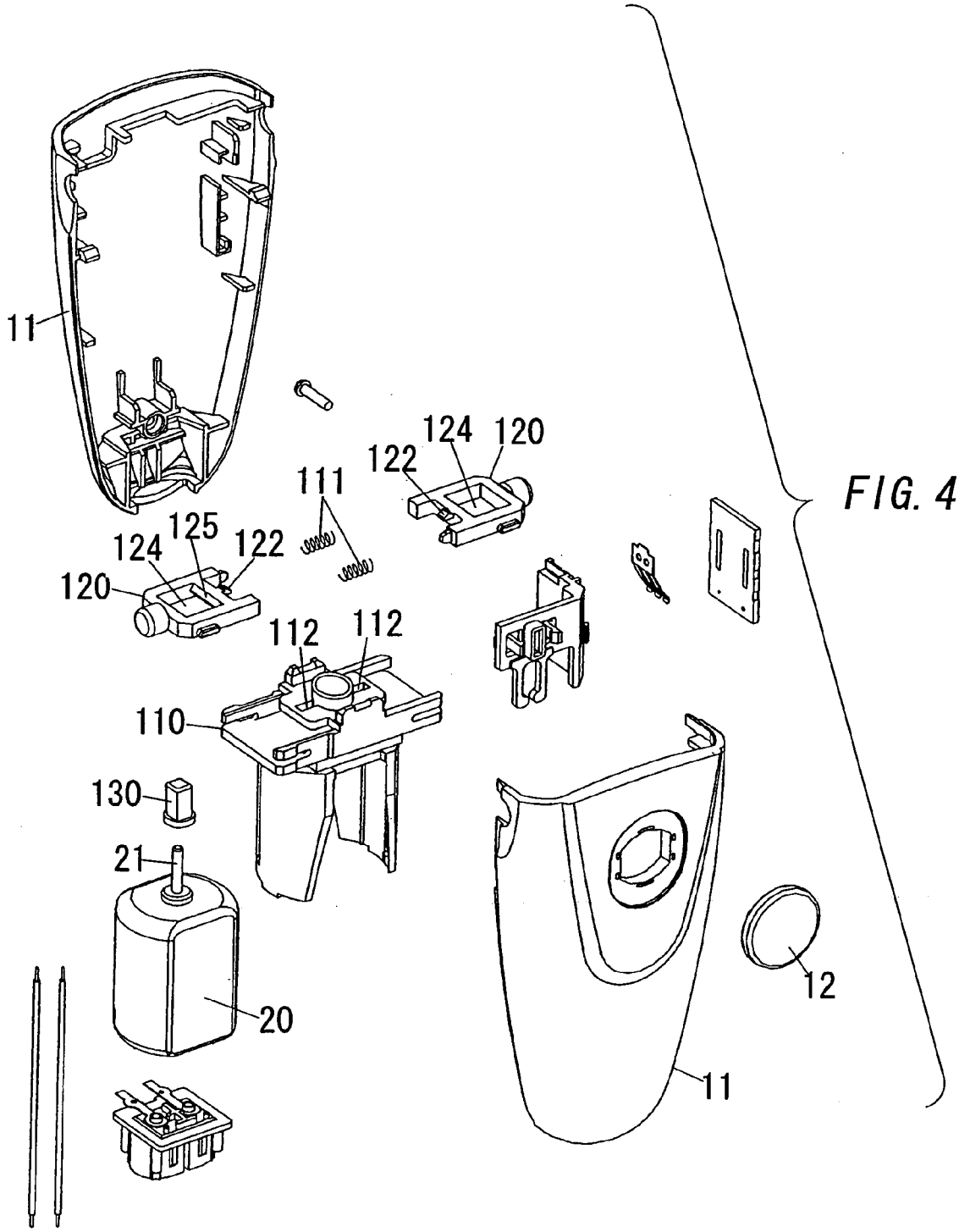
FIG. 4 is an exploded perspective view of a housing of the device.

The output rotor shaft 21 is fitted with a noncircular joint 22 having a polygonal section for driving connection with an associated coupler 130, 430 provided on the side of the epilator head 30 or the shaving head 300. The coupler 130, 430 is in the form of a sleeve having a socket hole for receiving the joint 22 such that the coupler 130, 430 is slidable along the axis of the joint 22 or the rotor shaft 21 while keeping the driving connection therebetween. The motor 20 is energized either by an A.C. mains or by an incorporated battery and is turned on and off by a switch button 12 on the housing 10. As shown in FIG. 4, the housing 10 is assembled from a pair of housing halves 11 and encloses a fixed chassis 110 which secures the motor 20 on its lower side and carries a pair of sliders 120 on its upper surface for detachable connection with the epilator head 30 or the shaving head 300. Each slider 120 is movable horizontally on the upper surface of the chassis 110 and is urged outwardly by a spring 111 until a stopper 122 engages with an outer end of a corresponding slot 112 in the center of the chassis 110. The slider 120 has an opening 124 for receiving therein anchor legs 32 or 332 projecting on the bottom of the epilator head 30 or the shaving head 300 in such a manner that the anchor leg 32 or 332 is hooked with one edge 125 of the opening. The slider 120 has a button 126 that projects outwardly of the housing to be accessible by the fingers of the user grasping the housing 10. Thus, simply by pressing the buttons 126 against the springs, the sliders 120 moves inwardly to unhook the anchor legs from the sliders 120 for detachment of the heads 30 or 300 from the housing 10. The slider 120 is formed with an inclined guide on the upper surface of the edge 125 for guiding the anchor leg 32 into hooking engagement with the edge 125.

As shown in FIGS. 2, 3, 5, and 6, the epilator head 30 includes a base frame 31 integrally formed with the anchor legs 32 for detachable connection with the housing 10, and a head frame 37 supporting the rotary cylinder 40 with a plurality of epilation members 61 and 71. As will be explained later in detail, the epilation members 61 and 71 are spaced along the center axis of the cylinder and are caused to shift along the axis towards and away from one another for pinching the hairs between the adjacent ones and releasing the hairs, thereby plucking the hairs pinched between the epilation members as the cylinder 40 rotates.

The epilator head 30 includes, in addition to the base frame 31 and the head frame 37, a base cover 33, a gear support 34, a platform 35, and a retainer 36, all of which are assembled together into a single unit detachable to the housing 10. A head cover 38 is detachably mounted to the retainer 36 and is cooperative with the base cover 33 to conceal a drive mechanism of the epilator head 30, and has an opening 39 through which the rotary cylinder 40 is exposed for contact with the skin of the user. The gear support 34 carries a center bearing 131 rotatably supporting an axle 132 which is secured at its lower end to the coupler 130 and is secured at its upper end to a pinion 133. Also mounted on the gear support 34 is a gear wheel 134 which meshes with the pinion 133 and with an intermediate gear 140 supported on the head frame 37. The intermediate gear 140 is a combination gear having a small gear 141 engaged with a face gear wheel 150 supported to the platform 35 and having a large gear 142 engaged with a gear wheel 144 integrally formed on one axial end of the cylinder 40 for rotating the cylinder 40 about its center horizontal axis. The face gear wheel 150 carries an eccentric cam 151 which engages into a follower cavity 137 in the bottom of the head frame 37 in order to transform the rotary motion of the gear wheel 150, i.e., the motor 20 into an oscillating movement of the cylinder 40 along its center axis for maximizing the chance of plucking the hairs on the surface of the cylinder 40.

The head frame 37 has an axle 138 which extends between a main-frame 37-1 and a sub-frame 37-2 which are assembled together with the intermediate gear 140 interposed therebetween. The head frame 37 is supported to the platform 35 and is driven to oscillate along the axle relative to the platform 35 or the base frame 31 while the cylinder 40 is rotated. Thus, the driving linkage of the epilator head 30 includes a first linkage leading from the coupler 130 to the gear wheel 144 for rotating the cylinder 40 and at the same time shifting the epilation members 61 and 71 for epilation of the hairs, and also includes a second linkage leading from the common coupler 130 to the face gear wheel 150 for oscillating the cylinder 40 along its center axis in synchronous with the rotation of the cylinder.

Figure 5:
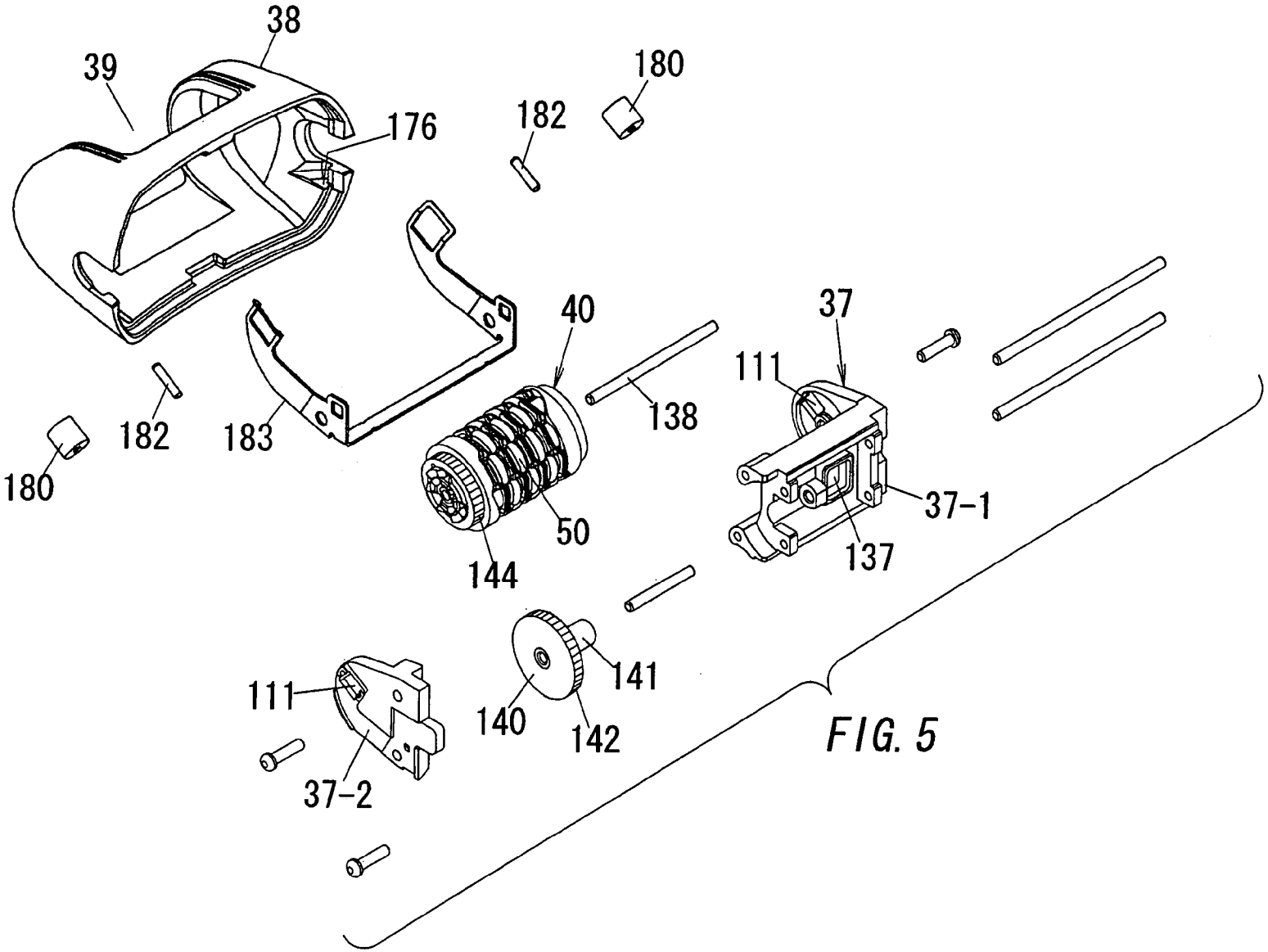
FIG. 5 is an exploded perspective view of an upper part of a epilator head of the above device.
Figure 6:
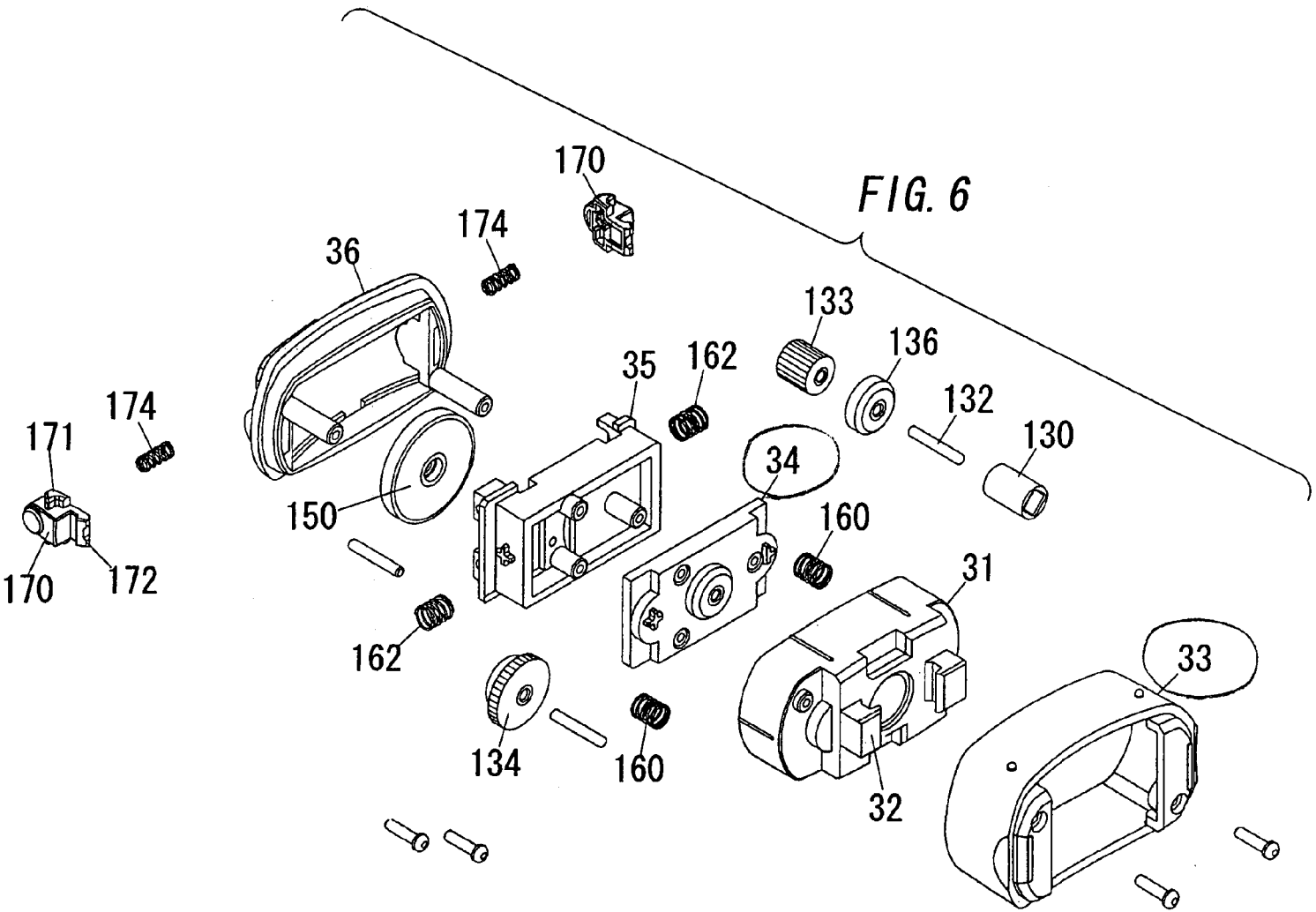
FIG. 6 is an exploded perspective view of a lower part of the epilator head.

Coil springs 160 are interposed between the base frame 31 and the gear support 34 so as to floatingly support the cylinder 40 in the vertical direction, thereby enabling the cylinder 40 to be depressed while making the hair epilation. Further, coil springs 162 are interposed between the base frame 31 and the platform 35 so as to floatingly support the cylinder 40 in the horizontal direction, thereby damping the oscillating movement of the cylinder 40 and therefore reducing the amount of the resulting vibration reaching the housing 10. Whereby, the user holding the housing 10 can be relatively free from the unpleasant vibrations for comfortable epilating operation. The head cover 38 is hooked on the retainer 36 by means of release buttons 170 on opposite upper width ends of the retainer 36. As shown in FIGS. 5 and 6, each button 170 has hooks 171 engageable with recesses 176 in the inner lower end of the head cover 38, and includes a leg 172 by which the button is secured to the retainer 36. When the button 170 is pressed against the bias of a coil spring 174 interposed between the button 170 and the retainer 36, the hooks 171 are disengaged from the recesses, thereby releasing the head cover 38 from the rest of the epilator head 30. It is noted in this connection that the coils springs 174 are also utilized to absorb the vibrations of the retainer 36 oscillating together with the cylinder 40, thereby preventing the vibrations from being transmitted to the housing 10, through the bottom cover 33. That is, the coils springs 160, 162, and 174 are responsible for absorbing the vibrations of the cylinder 40 to make the housing 10 relatively free from the vibrations, assuring the comfortable epilating operation. Although the illustrated embodiment discloses the use of the coil springs, the present invention should not limited to the use of the coil springs and may equally use any other elastic members such as a rubber or other types of springs.

Figure 8:
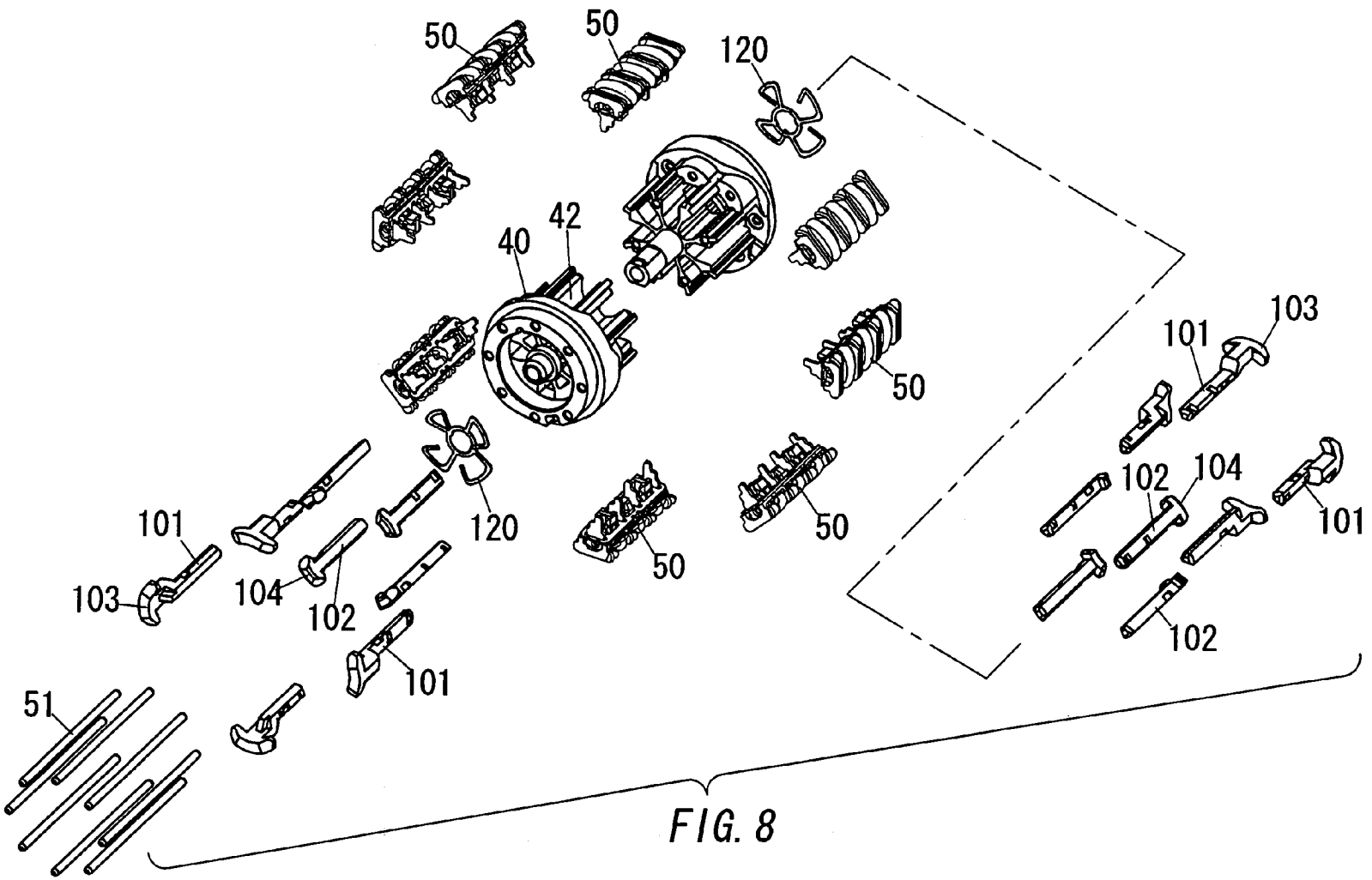
FIG. 8 is an exploded perspective view of the cylinder.
Figure 9:
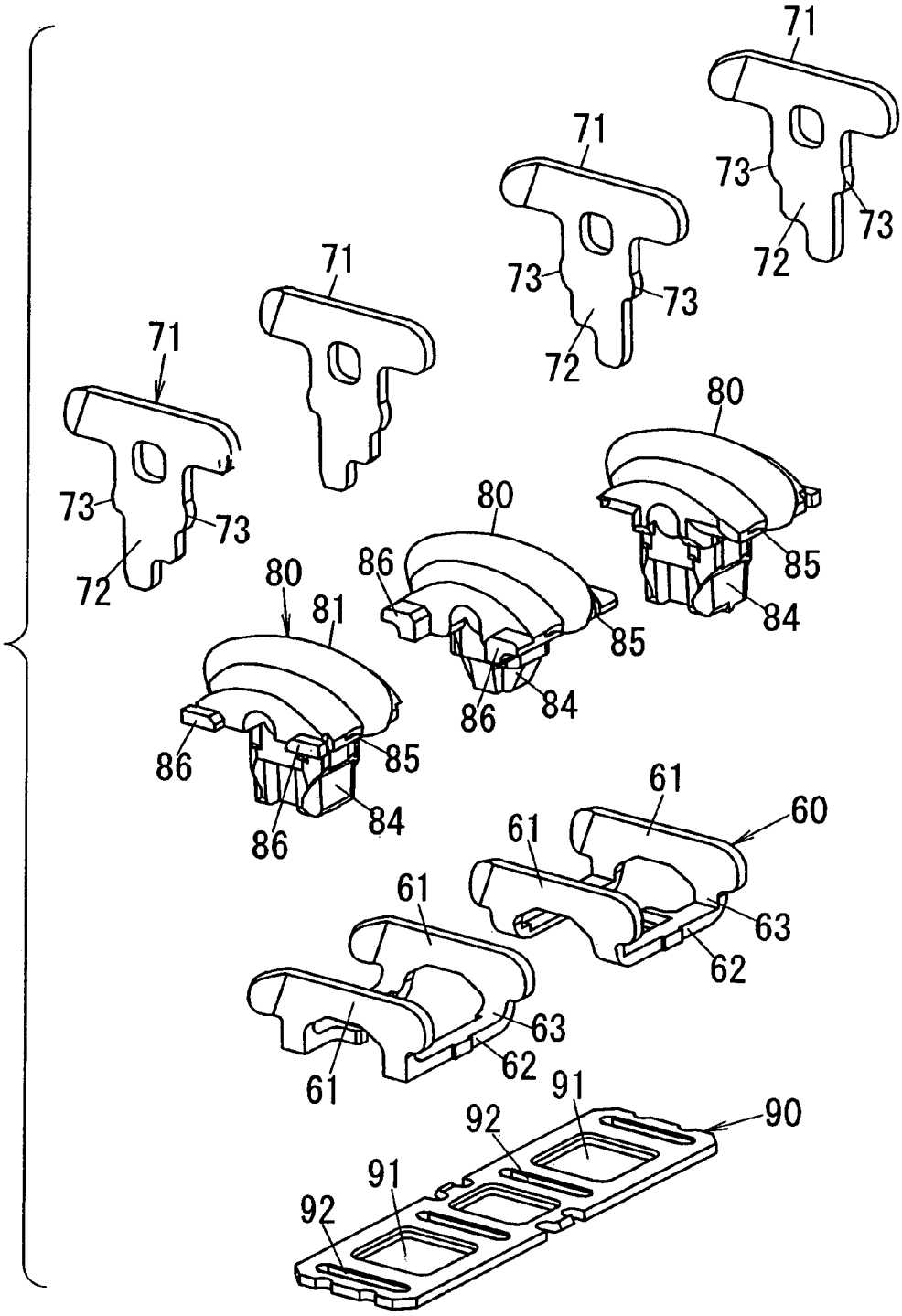
FIG. 9 is an exploded perspective view of a pinching row unit carried on the cylinder

The rotary cylinder 40 carries a plurality of hair pinching row units 50 which are evenly spaced around the circumference of the cylinder. As best in FIGS. 8 and 9, each row unit 50 includes four stationary blades 61 which are aligned along the axis of the cylinder, four movable blades 71 which alternate the stationary blades, and three skin guides 80 interposed between the adjacent stationary blades 61. These members are commonly supported to a single metal-made holder plate 90 to define a self-sustained sub-assembly which is easily fitted around the cylinder 40. The movable blades 71 are caused to pivot about an axis perpendicular to the center axis of the rotary cylinder 40 to open and close the gap between the adjacent blades 61 and 71 as the rotary cylinder 40 rotates about the axis, thereby catching and pinching the hairs between the blades. The closure of the blades 61 and 71 are kept over a certain angular displacement around the axis, i.e., a fraction of one rotation of the rotary cylinder 40, thereby pulling the hairs pinched between the blades 61 and 71 in a tangential direction of the cylinder 40 for plucking the hairs. Because of the above hair epilation function, the blades 61 and 71 are referred to generally as the epilation members in the description and claims.

As shown in FIG. 6, the two stationary blades 61 are shaped from a metal plate into an integrated piece 60 in which the blades 61 are inseparably continuous with one another through a pair of beams 62. The skin guide 80 is molded from a plastic material to have an arcuate surface 81 on its top for smooth contact with the skin of the user, and an anchor stud 84 which projects to be press-fitted into a corresponding hole 91 of the holder plate 90 by the use of resiliency inherently given to the molded part. Formed at the opposite side of the skin guide 80 are grips 85 which presses the beams 62 of the integrated piece 60 against the holder plate 90 so as to secure the stationary blades 61 to the holder plate at the same time as the skin guide 80 is secured to the plate. The movable blade 71 is made of a metal and has a leg 72 of which lower end is inserted into a corresponding slot 92 of the plate 90 so that the leg comes into edge-contact selectively with either one of the opposite edges of the slot 92. Formed on opposite of the leg are round projections 73 which cam over inclines of hooks 86 on the skin guide 80 and are retained loosely behind the hooks 86. Whereby, the movable blades 71 can be pivotally supported to the holder plate 90 and complete the self-sustained sub-assembly which can be handled as one block when assembling the pinching row units into the rotary cylinder 40. Two integrated pieces 60, i.e., four stationary blades 61, four movable blades 71, and three skin guides 80 are supported to one holder plate 90 to constitute each one of the plural pinching row units 50. After the row units 50 are placed in corresponding grooves 42 of the rotary cylinder 40, a corresponding number of pins 51 are inserted into the cylinder with each pin extending through the stationary blades 61, the movable blades 71, and the skin guides 80 to hold the row units in position where, as best shown in FIG. 7, the movable blades 71 are linked to actuator bars 101 and 102 which are inserted in the rotary cylinder 40 for imparting the pivotal movement to the movable blades 71 for closing and opening the gap between the blades 61 and 71.

Figure 2:
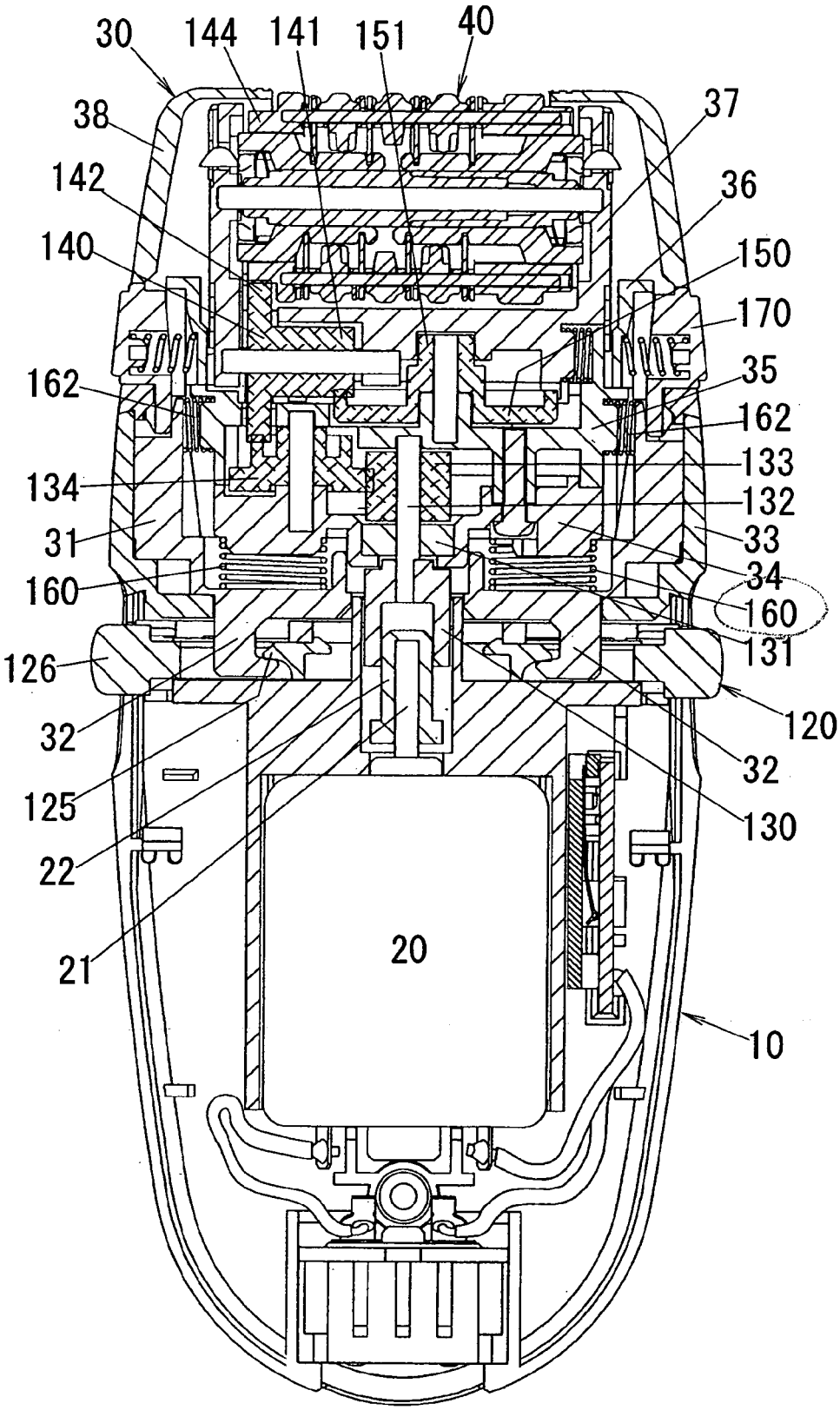
FIG. 2 is a front vertical section of the above device.
Figure 3:
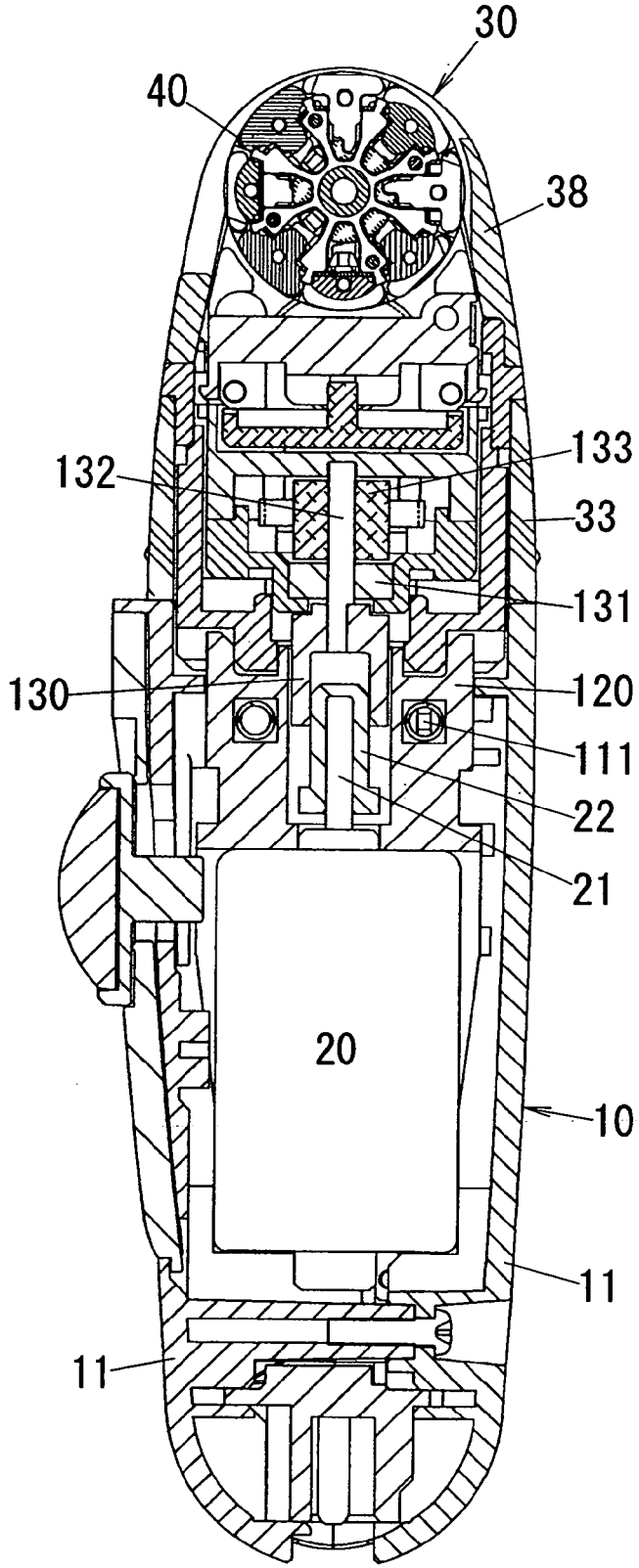
FIG. 3 is a side vertical section of the above device.
Figure 7:
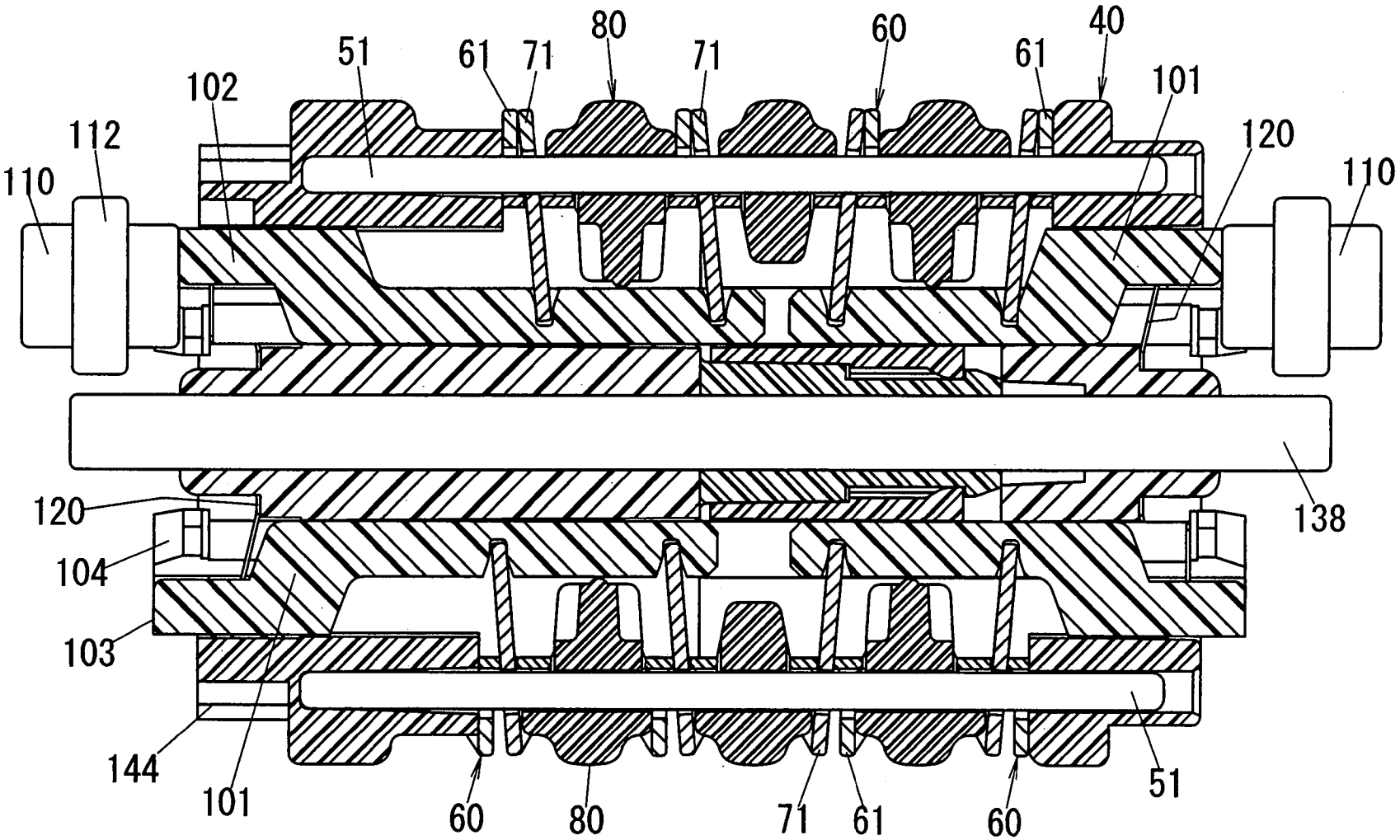
FIG. 7 is a cross-section of a cylinder provided in the epilator head.

The actuator bars 101 and 102 are provided in number double the number of the row units 50, i.e., eight bars in each longitudinal half of the cylinder 40 so that each bar is linked to actuate the two adjacent movable blades 71 in each one of the row units 50, as shown in FIGS. 2 and 7. That is, each actuator bar is linked to actuate the two movable blades 71 simultaneously to open and close in association with the two stationary blades 61 of each integrated piece 60. The actuator bars 101 and 102 are held in the bottom of the groove 42 of the rotary cylinder 40 to be axially slidable and are caused to move axially inwardly by the action of cam rollers 180 as the cylinder 40 rotates, and to move axially outwardly by the action of return springs 120 as the cylinder 40 further rotates, thereby repeating to close and open the blades during one rotation of the cylinder.

The actuator bars 101 and 102 are each formed at its axially outer end with an arcuate flange 103, 104 which extends circumferentially about the longitudinal axis of the cylinder 40 for pressed contact with the corresponding cam roller 180 over a prolonged period as the cylinder 40 rotates. The cam roller 180 has an axial length so that it contacts simultaneously with the arcuate flanges 103 and 104 of the outer and inner circumferential rows, respectively. Thus, as the cylinder 40 rotates, the movable blades 71 in two or three adjacent row units 50 of the cylinder 40 are simultaneously closed, while the movable blades 71 in the other row units are opened. As shown in FIG. 5, the cam rollers 180 are mounted respectively in holes 111 of the head frame 37 and are rotatable about individual pins 182. Each cam roller is pressed inwardly against the actuator bar 101, 102 by spring props 183 secured to the head frame 37.

The return springs 120 are provided on opposite ends of the cylinder 40 for biasing the actuator bars 101 and 102 axially outwardly with one spring responsible for the eight actuator bars having the arcuate flanges 103 and 104 disposed on one end of the cylinder, and the other spring for the remaining eight actuator bars having the arcuate flanges 103 and 104 on the other end of the cylinder 40.

The row units 50 are arranged on the cylinder 40 as being offset in the axial direction relative to each other so that the pairs of the stationary blade 61 and the movable blade 71 in anyone of the row units are staggered with the other pairs of the other row units with respect to the longitudinal axis of the cylinder, so that all the blade pairs are differently positioned with respect to the longitudinal axis of the cylinder for maximum plucking efficiency.

Now referring to FIGS. 10 to 13, the shaving head 300 is explained in detail. The shaving head 300 includes a base frame 331 integrally formed with the anchor legs 332 for detachable connection with the housing 10, a head frame 337 carrying the inner cutter 320, and a head cover 338 carrying the outer shearing foil 310. The base frame 331 and the head frame 337 are secured together with a base cover 333 to constitute a single unit detachable to the housing 10, while the head cover 338 is detachable to the base cover 333 by means of a release button 370. The shaving head 300 includes, in addition to the base frame 331, the head frame 337 and the base cover 333, a closure plate 335, and a retainer 336, all of which are assembled together into a single unit detachable to the housing 10. The head cover 338 is cooperative with the base cover 333 to conceal a shaving drive mechanism of the shaving head 300. The base frame 331 holds a bearing 431 rotatably supporting an axle 432 which is secured at is lower end to the shaving coupler 130 for connection with the joint 22 on the side of the housing 10, and which is secured at its upper end to an eccentric cam 433 with a pin 434 eccentric to the axle 432. The head frame 337 carries a reciprocator 350 with a center stud 351 to which the inner cutter 320 is attached. The reciprocator 350 is formed on its opposite width ends with resilient arms 352 by which the reciprocator 350 is mounted on the head frame 337 so that a center rigid section 354 including the stud 351 is movable along a width axis of the shaving head 300. The eccentric pin 434 fits into the center rigid section 354 so as to translate the rotary motion of the coupler 430, i.e., the motor 20 into the reciprocating motion of the inner cutter 320 for shaving the hairs with the outer shearing foil 310. Thus, the drive mechanism of the shaving head 300 is established by the coupler 130, the eccentric cam 433, the pin 434 and the reciprocator 350. In this regard, the drive mechanism of the shaving head translates the rotary motion of the motor directly into the reciprocating motion of the cutter, i.e., without any intervening reducing gear such that the cutter can reciprocate at a frequency higher than a rotational speed at which the cylinder of the epilator head rotates about the center axis.

The closure plate 335 is fitted to close the upper opening of the head frame 337 while allowing the portions of the reciprocator 350 to project on the closure plate. The retainer 336 is placed over the closure plate 335 to cover the connections of the resilient arms 352 to the head frame 337 as well as to support a seal ring fitted around the stud 351. The release button 370 is supported by the retainer 336 and is urged outwardly by means of a spring 374. When the button 370 is pressed inward, it is disengaged from the head cover 338 for detachment of the head cover from the rest of the shaving head.

The shaving head 300 additionally includes a trimmer unit 380 for cutting relatively long hairs. The trimmer unit 380 includes a movable cutter 381 which is drivingly connected to the stud 351 by way of a fitting 356 attached to the stud 351.

The shaving head 300 of the illustrated structure is shown only for an example, and therefore the present invention should not be limited to this specific structure of the shaving head and could be equally applied to shaving heads of any other structure provided that at least one cutting element is powered by the rotary motion received at the coupler 130 which is detachably connected to the non-circular joint 30 on the side of the housing 10.

Further, it should be noted that the joint 22 and the associated coupler 130 and 430 should not be limited to have the illustrated square section, and could be shaped to have any other analogous section such as triangular, polygonal or elliptic section.

The invention claimed is:

1. A hair removing device comprising:

a housing incorporating therein a rotary motor; and an epilator head carrying epilation members for removing hairs from the user's skin, said epilator head being detachably mounted to said housing and including a drive mechanism which is powered by said motor to actuate said epilation members, said motor having an output rotor shaft fixedly carrying a noncircular joint;

said drive mechanism including a coupler which is detachably connected to said joint to receive the rotary motion of said motor, said coupler being coaxial with said joint and movable together with said epilator head into and out of engagement with and from said joint, said coupler being slidable along the axis of said joint while keeping a driving connection therebetween, wherein said epilator head includes a cylinder having a center axis and carrying said epilation members, said drive mechanism including a first linkage leading from said coupler for rotating the cylinder about said center axis in order to pluck the hairs, said device further including:

a shaving head which is selectively detachable to said housing in place of said epilator head for cutting the hairs, said shaving head carrying a cutter and including a shaving drive mechanism which is powered by said motor to move said cutter for cutting the hairs, said shaving drive mechanism including a shaving coupler which is detachably connected to said joint for receiving the rotary motion of said motor, said shaving drive mechanism translates the rotary motion of the motor directly into the reciprocating movement of said cutter without any intervening reduction gear, wherein said first linkage is provided to shift said epilation members along said center axis towards and away from one another to pinch the hairs between the adjacent hair epilation member, while rotating the cylinder about said center axis in order to pluck the hairs pinched between the adjacent hair epilation members, said drive mechanism further including a second linkage leading from said coupler for rotating said cylinder about said center axis for oscillating the cylinder along said center axis, said cylinder being arranged to have its center axis lying substantially in a coplanar relation with the axis of said joint.

2. The device as set forth in claim 1, wherein said coupler is in the form of a sleeve defining therein a socket hole into which said joint fits, said coupler being recessed from a bottom end of said epilator head.

3. The device as set forth in claim 1, wherein the coupler of said epilator head is integrally formed with a coaxial pinion which engages with a common gear wheel forming a part of said first and second linkages.

4. The device as set forth in claim 1, wherein said epilator head includes a base detachable to said housing, and a frame mounting a plurality of gears forming said first and second linkages in addition to said cylinder, said frame being supported to said base by way of spring means to be movable relative to said base against the bias of said spring means.

5. The device as set forth in claim 4, wherein said frame is movable relative to said base against the bias of said spring means in a direction along said axis of said joint as well as in a direction along the center axis of said cylinder.

6. The device as set forth in claim 1, wherein the coupler of said shaving head is integrally formed with an eccentric cam which engages with a reciprocator carrying said cutter for translating the rotary motion of the motor into a reciprocating movement of said cutter.

7. A hair removing device comprising:

a housing incorporating therein a rotary motor; and an epilator head carrying epilation members for removing hairs from the user's skin, said epilator head being detachably mounted to said housing and including a drive mechanism which is powered by said motor to actuate said epilation members, said motor having an output rotor shaft fixedly carrying a noncircular joint;

said drive mechanism including a coupler which is detachably connected to said joint to receive the rotary motion of said motor, said coupler being coaxial with said joint and movable together with said epilator head into and out of engagement with and from said joint, said coupler being slidable along the axis of said joint while keeping a driving connection therebetween, wherein said epilator head includes a cylinder having a center axis and carrying said epilation members, said drive mechanism including a first linkage leading from said coupler for rotating the cylinder about said center axis in order to pluck the hairs, said device further including:

a shaving head which is selectively detachable to said housing in place of said epilator head for cutting the hairs, said shaving head carrying a cutter and including a shaving drive mechanism which is powered by said motor to move said cutter for cutting the hairs, said shaving drive mechanism including a shaving coupler which is detachably connected to said joint for receiving the rotary motion of said motor, said shaving drive mechanism translates the rotary motion of the motor directly into the reciprocating movement of said cutter without any intervening reduction gear, wherein said first linkage is provided to shift said epilation members along said center axis towards and away from one another to pinch the hairs between the adjacent hair epilation member while rotating the cylinder about said center axis in order to pluck the hairs pinched between the adjacent hair epilation members, and wherein said shaving drive mechanism translates the rotary motion of the motor into the reciprocating movement of said cutter such that said cutter can reciprocate at a frequency higher than a rotational speed of said cylinder.

* * * * *